United States Patent [19]

Belisle

[11] Patent Number: 4,823,956

[45] Date of Patent: Apr. 25, 1989

[54] COMPOSITE CONTAINER AND ITS METHOD OF MANUFACTURE

[75] Inventor: John I. Belisle, Hampton, Minn.

[73] Assignee: Donaldson Company, Inc., Minneapolis, Minn.

[21] Appl. No.: 896,420

[22] Filed: Aug. 13, 1986

[51] Int. Cl.[4] ..... B65D 81/02; B65D 85/30

[52] U.S. Cl. ..... 206/523; 206/524; 206/588; 206/591; 206/407; 206/416; 229/109; 229/DIG. 2

[58] Field of Search ..... 206/407, 415, 416, 521, 206/523, 524, 588, 591; 229/109, 110, DIG. 2, DIG. 5

[56] References Cited

U.S. PATENT DOCUMENTS

| | | | |
|---|---|---|---|
| 532,954 | 1/1895 | Grimm . | |
| 654,255 | 7/1900 | Hunter . | |
| 1,883,323 | 10/1932 | Andrews | 229/109 |
| 1,888,855 | 11/1932 | Fuller | 206/419 |
| 2,620,119 | 12/1952 | George | 229/109 |
| 2,710,134 | 6/1955 | Schroeder et al. | 229/DIG. 2 |
| 2,798,596 | 7/1957 | Emmons | 229/DIG. 2 |
| 2,893,436 | 7/1959 | Mann | 229/DIG. 2 |
| 3,137,217 | 6/1964 | Elliott | 229/DIG. 2 |
| 3,173,535 | 3/1965 | Wood | 206/524 |
| 3,203,617 | 8/1965 | Paige | 229/DIG. 2 |
| 3,708,084 | 1/1973 | Bixler et al. . | |
| 3,710,931 | 1/1973 | Hollinger | 229/DIG. 2 |
| 3,750,871 | 8/1973 | Cook | 206/523 |
| 3,791,514 | 2/1974 | Watanabe | 206/407 |
| 3,837,560 | 9/1974 | Kuchuris et al. . | |
| 4,059,220 | 11/1977 | Lorenz | 229/DIG. 2 |
| 4,195,732 | 4/1980 | Bell . | |
| 4,201,293 | 5/1980 | Rigazio et al. | 206/523 |
| 4,335,813 | 6/1982 | Bessett et al. . | |
| 4,375,262 | 3/1983 | Hrenyo . | |
| 4,460,087 | 7/1984 | DeMarco et al. | 206/415 |
| 4,482,054 | 11/1984 | Gardner | 206/597 |
| 4,560,069 | 12/1985 | Simon | 206/523 |

FOREIGN PATENT DOCUMENTS

| | | | |
|---|---|---|---|
| 265580 | 10/1968 | Austria | 206/407 |
| 1410347 | of 1965 | France | 206/523 |
| 2223254 | 10/1974 | France | 206/523 |
| 557129 | 11/1943 | United Kingdom | 206/523 |
| 888860 | 2/1962 | United Kingdom | 206/415 |

*Primary Examiner*—David T. Fidei

*Attorney, Agent, or Firm*—Merchant, Gould, Smith, Edell, Welter & Schmidt

[57] ABSTRACT

A unique composite shipping container (10) comprises a straight tubular sidewall (12) of predetermined polygonal cross-sectional configuration which is preferably formed from corrugated fiberboard. Opposite open ends of the sidewall (12) are closed by foam end caps (14), which are preferably formed from expanded polystyrene to close the container and cushion the product (16) therein against shock. The end caps (14) are secured to the sidewall (12) by tape (18) or other suitable fastening techniques to seal the container (10).

5 Claims, 4 Drawing Sheets

COMPOSITE CONTAINER AND ITS METHOD OF MANUFACTURE

TECHNICAL FIELD

The present invention relates generally to a packaging technique, and more particularly to a composite container for more efficient packaging of products, such as fluid filters, resulting in labor, material and cost savings.

BACKGROUND ART

Corrugated fiber board or cardboard boxes are typically used to package a variety of products. Such containers are generally rectangular in shape and comprise a surrounding sidewall with opposing pairs of flaps at opposite ends which are folded inwardly and secured to enclose the product(s) inside the box. Standard boxes of this general type are available in various sizes depending upon the products to be shipped. If additional protection is needed during shipping and handling, cushioning pads are typically placed inside the box before closing and sealing the end flaps. Such cushioning pads have been formed from expanded polystyrene foam and other suitable material.

Although folded cardboard boxes with or without interior cushioning pads have been used before to package various products for years, there are definite drawbacks to this packaging approach. The use of cushioning pads involves additional pieces whose function overlaps to some extent with that of certain portions of the box. For example, when a cylindrical fluid filter is packaged for shipment, molded interior cushioning pads are typically provided between the filter and opposite ends of the box, each of which includes two pairs of opposing flaps that are folded inwardly in double layers before sealing. The folded end flaps provide some cushioning, but are really unnecessary when interior cushioning end pads are utilized, which in turns results in material waste and thus increased expense. In addition to the cushioning shipping pads, the boxes must be sized as necessary and stocked and inventoried in various sizes, which is expensive. Shipment and delivery schedules depend upon production and an adequate supply of containers, the requirements for which can be highly variable. Further, the use of rectangular boxes requires more shipping volume, resulting in the less efficient use of available shipping space, which increases shipping costs. It will thus be appreciated that the traditional approach to packaging and shipment of some products, such as fluid filters and the like, can involve substantial expense.

Expanded polystyrene foam has been utilized before in certain packaging applications. For example, U.S. Pat. Nos. 4,375,262 and 4,335,813 illustrate molded cartons or packages having hinged complementary covers for enclosing eggs, lightbulbs and the like, wherein the entire container is constructed from foam. U.S. Pat. No. 4,195,732 relates to a supporting and spacing member for web material rolls. U.S. Pat. No. 3,837,560 relates to an expanded storage containers. U.S. Pat. No. 3,708,084 shows a molded packing element for use in packing cases of fragile articles such as flourescent light tubes. Heretofore, however, there has not been available a composite container wherein foam has been used both for closing the container and cushioning the product(s) therein.

A need has thus arisen for a composite contained which combines the functions of the cushioning and packaging materials a more efficient manner to avoid waste while achieving cost savings in manufacture and shipping.

SUMMARY OF INVENTION

The present invention relates to a composite container which overcomes the forgoing and other difficulties associated with the prior art. In accordance with the invention, there is provided a composite shipping container and method of manufacture thereof. The container herein comprises a straight tubular sidewall of polygonal crosssection closed at opposite ends by foam end caps secured in place by tape, glue or other suitable fastening means. The sidewall is preferably formed from corrugated fiberboard. The end caps, which serve the dual purpose of both closing the ends of the container and cushioning the product therein, are preferably formed from expanded polystyrene foam. The inner surfaces of the end caps include recesses for engaging and centering the product therebetween. The surrounding circumferential surfaces of the end caps are also polygonal, and can include a shoulder, but are preferably straight so that the ends of the sidewall are flush with the outer surfaces of the end caps for better durability.

BRIEF DESCRIPTION OF DRAWINGS

A better understanding of the invention can be had by reference to the following Detailed Description in conjunction with the accompanying Drawings, wherein.

DETAILED DESCRIPTION

Figure 4:
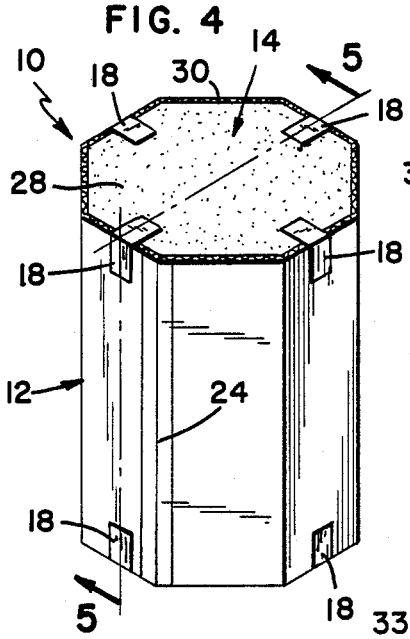
FIG. 4 is a perspective view of the composite container of the invention.
Figure 5:
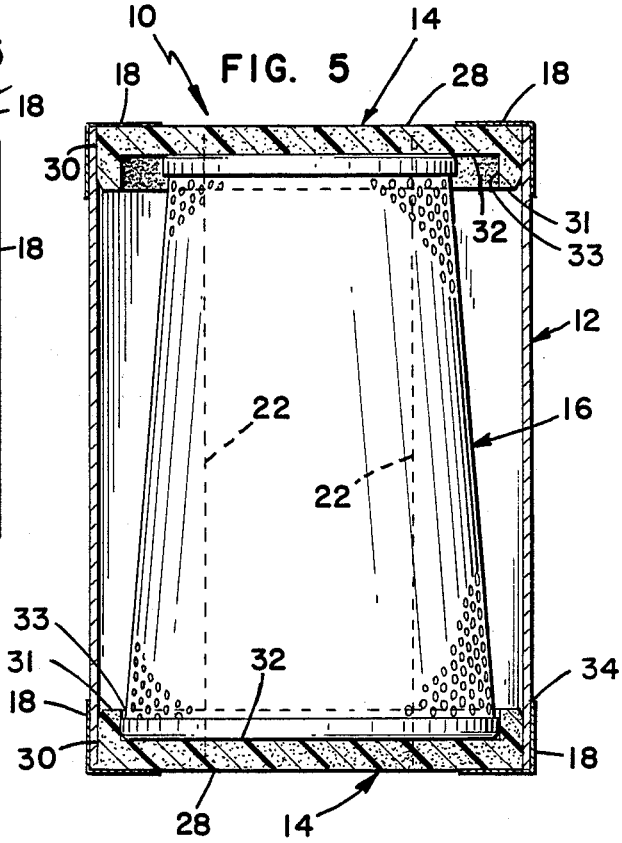
FIG. 5 is an enlarged vertical sectional view taken along lines 5—5 of FIG. 4 in the direction of the arrows.

Referring now to the Drawings, wherein like reference numerals designate like or corresponding elements throughout the views, and particularly referring to FIGS. 4 and 5, there is shown the composite container 10 of the present invention. As will be explained more fully hereinafter, the container 10 is a package of simplified, more efficient construction which results in cost savings in both assembly and shipment.

The composite container 10 comprises a vertical sidewall 12 closed at opposite ends by end caps 14. The end caps 14, which serve the dual purpose of closing opposite ends of the sidewall 12 while cushioning the product 16 therein, are secured in place by tape 18 or other suitable fastening techniques, including adhesives. As illustrated, the product 16 within the container 10 is an air filter of generally truncated, cylindrical configuration, although it will be understood that the container herein can be utilized for packaging various products of cylindrical or other configurations.

Figure 2:
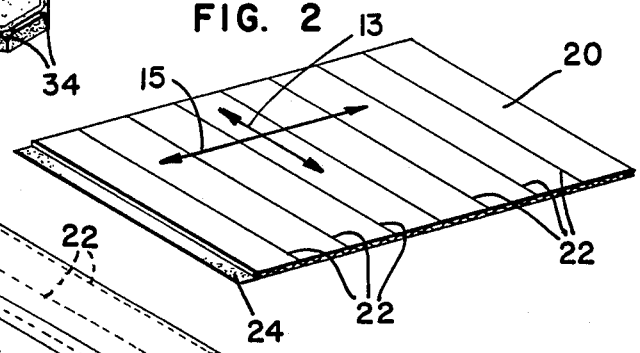
FIGS. 2 and 3 are prespective views of the sidewall of the composite container of the invention, shown in flat and folded tubular positions, respectively.
Figure 3:
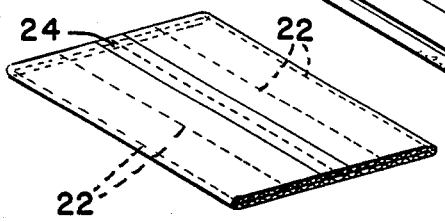

Referring now to FIGS. 2 and 3 in conjunction with FIG. 4, the vertical sidewall 12 of the composite container 10 is preferably formed from corrugated fiberboard. As illustrated, the corrugations of the sidewall 12 are oriented vertically or longitudinally as indicated by arrow 13, although it has been found that horizontal or circumferential circumfential orientation (as indicated by arrows 15) of the sidewall corrugations improves resistance to ripping, which typically starts at an end of the container 10, with only a small compromise in vertical stacking strength. For example, corrugated fiberboard of the 275 lb. type with a mullen burst test of 200 and a B or C flute can be utilized Such material is commercially available from Longview Fiber of Cedar Rapids, Iowa, or Mead Container of Waterloo, Iowa. Although the sidewall 12 of the container 10 is preferably formed from corrugated fiberboard, it will be understood that other suitable materials, such as plastic, can also be utilized.

The sidewall 12 of container 10 is of polygonal crossectional configuration to improve strength and shipping volume utilization. As illustrated, the sidewall 12 is octagonal, although it could be hexagonal or of other suitable polygonal configuration. The use of a polygonal sidewall is an important feature of the present invention because of the increased strength provided by the longitudinal bends or folds, and better shipping volume utilization and packing density.

Referring now to FIGS. 2 and 3, the sidewall 12 is preferably formed from a rectangular sheet or blank 20 of corrugated fiberboard as described above, which includes a plurality of score lines 22 on one side extending in spaced-apart relationship between opposite ends thereof. As illustrated, the score lines 22 extend entirely between opposite edges of the sheet 20, although it may not be necessary for them to extend completely from edge-to-edge in some cases. Opposite ends of the blank of corrugated fiberboard 20 are secured in abutting relationship by a piece of tape 24 or other suitable fastening means to form a manufacturing joint, so that the fiberboard blank 20 can be collapsed into a flat tube 26 as shown in FIG. 3, for convenient storage in inventory until expanded to form the sidewall 12 as will be explained hereinafter.

Figure 1:
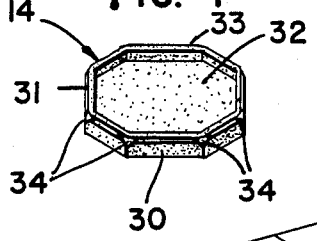
FIG. 1 is a perspective view of an end cap of the composite container of the invention.
Figure 11:
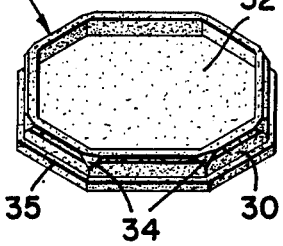
FIG. 11 is a perspective view of a modified end cap.
Figure 12:
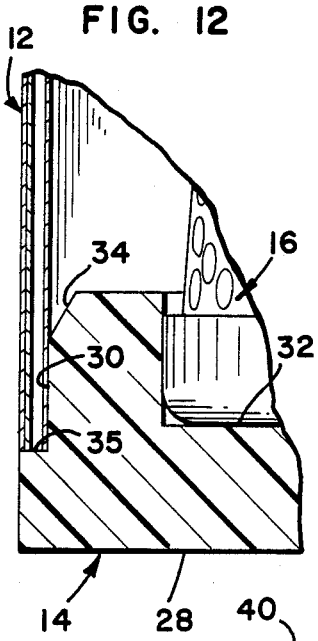
FIG. 12 is an enlarged partial vertical crosssectional view of a corner of the composite container herein with the modified end cap.

Referring now to FIG. 1 in conjunction with FIGS. 4 and 5, the constructional details of the end cap 14 will be seen. Each solid end cap 14 includes a flat outer end surface 28 and a surrounding polygonal side surface 30 of similar shape to the sidewall 12; i.e., alternating corners and flat sections. The surrounding polygonal side surface 30 and raised inner end surface 31 define a recessed inner surface 32 for receiving an end of the product 16. Inner end surfaces 31 and 32 are joined by a surrounding inside surface 33. In the preferred embodiment, the peripheral surface 30 is straight so that the ends of the sidewall 12 will be flush with the outer surfaces 28 of the end caps 14, although a lip or shoulder 35 can be provided as shown in FIGS. 11 and 12. The inner ends of corners 34 of the peripheral side surface 30 are preferably chamfered as shown to facilitate insertion into the sidewall.

The end caps 14 are preferably formed from solid expanded polystyrene foam having a density of at least 1.5 lb per cubic feet. Molded foam parts of such material are commercially available from Tuscarrora Plastics of Sun Prairie, Wis. or from Polyform Inc. of Lester Prairie, Minn. Although the end caps 1 are preferably formed from expanded polystyrene foam, it will be understood that other suitable materials could also be utilized.

Container 10 is shown with end caps 14 having recessed inner surfaces 32 of similar sizes; however, different sizes can be used, if desired.

FIGS. 6 through 10 illustrate the method of packaging product 16 with the composite container 10 of the invention. Assembly involves use of a clamshell-like fixture 36 including a female portions 38 and 40. The fixture 36 comprises a fixed portion 38 and a movable portion 40, which is mounted for pivotal and slidable movement relative to the fixed portion. Stops 41 on the fixed portion 38 limit opening pivotal movement of the movable portion 40. The complementary portions 38 and 40 define the desired polygon when closed.

Figure 7:
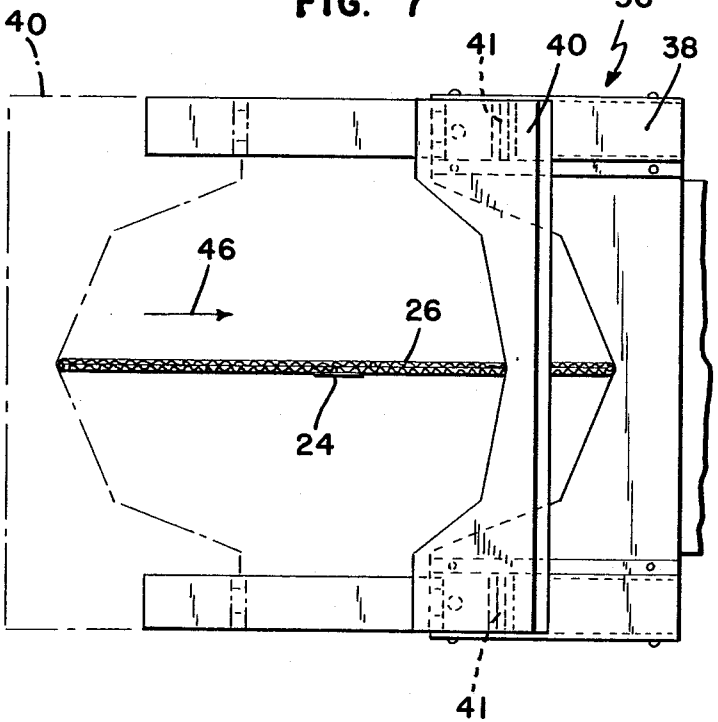
FIGS. 6 and 7 are side elevational and top plan views, respectively, of a fixture used in assembling the composite container herein, shown in open position.
Figure 6:
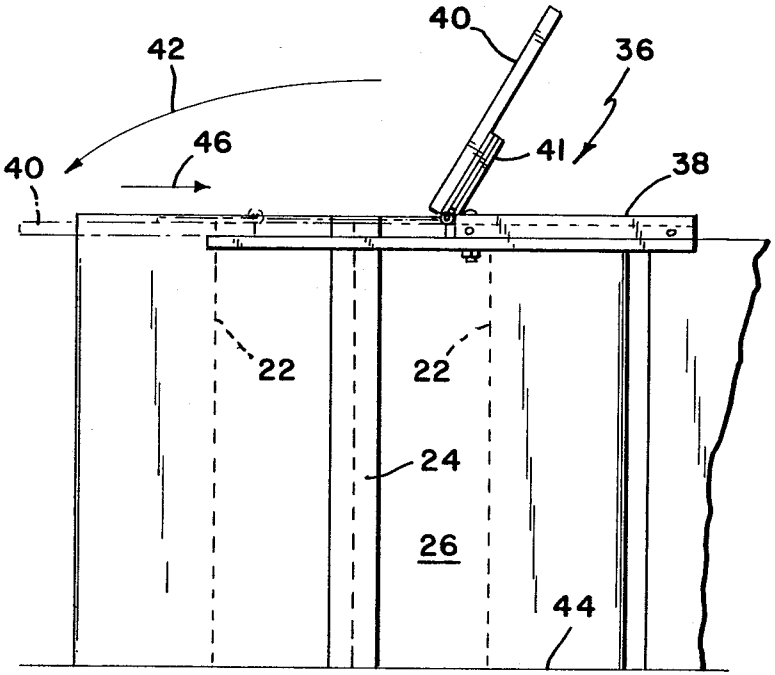
Figure 9:
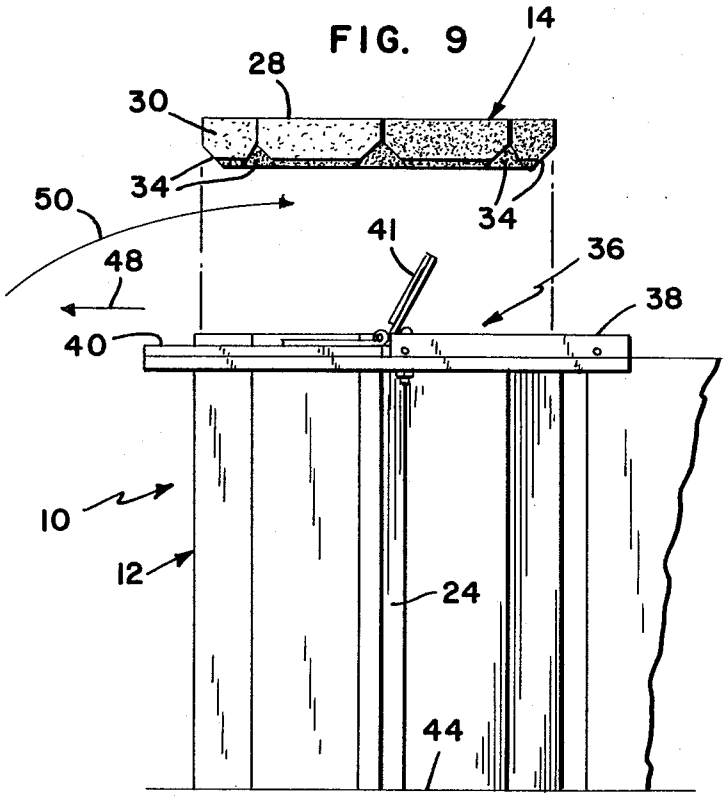
FIGS. 8 and 9 are top plan and side elevational views, respectively, of the assembly fixture, shown in closed position.

FIGS. 6 and 7 show the assembly fixture 36 in the open position. After the flat tubular blank 26 has been inserted into the fixed portion 38, the movable portion 40 is pivoted downwardly as indicated by arrow 42 to the position shown in phantom lines behind the opposite end of the flat tubular blank, the lower edge of which is supported on a flat surface 44.

Figure 8:
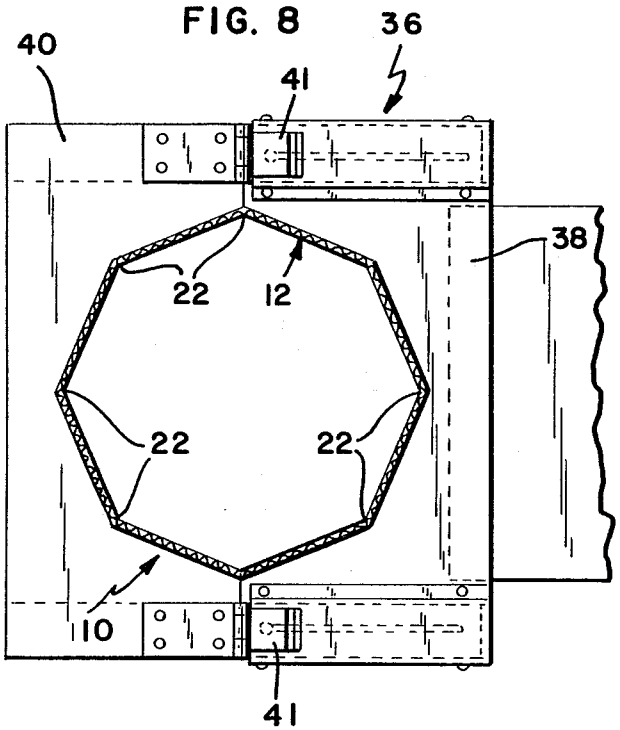
Figure 10:
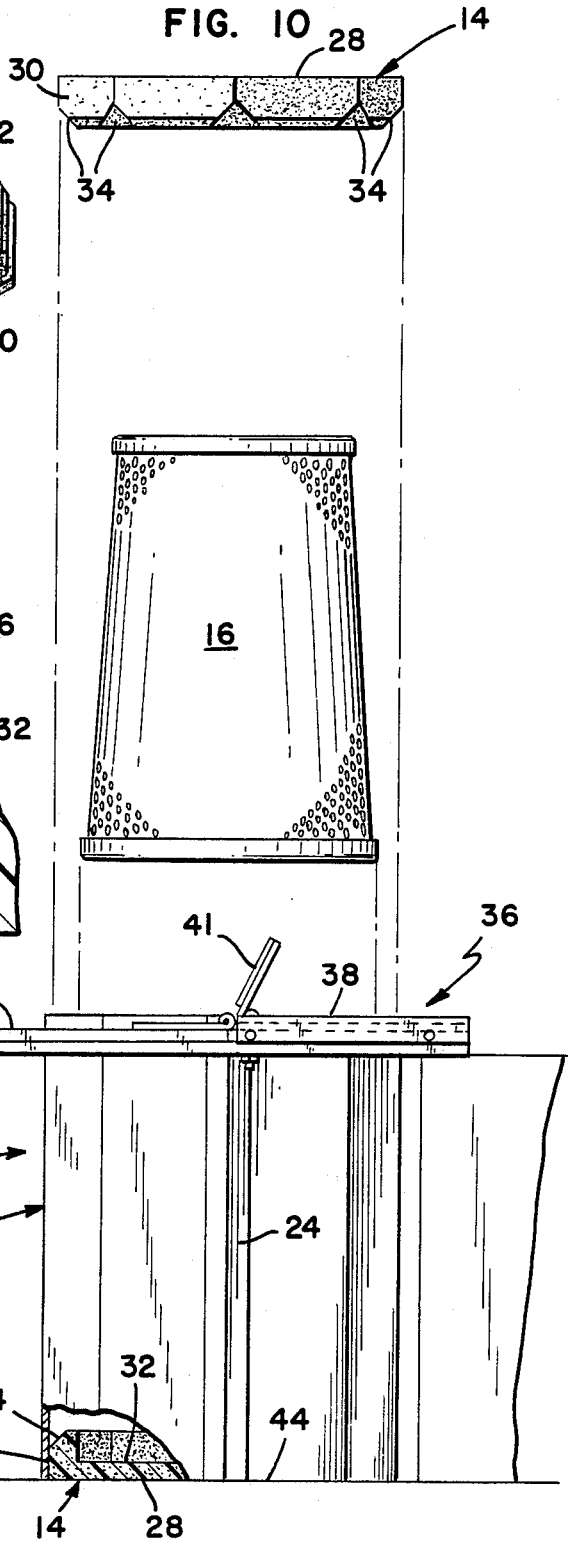
FIG. 10 is an exploded side elevational view of the composite container assembled according to the invention.

The movable portion 40 is then pushed inwardly as indicated by arrow 46 to the position shown in FIG. 8, in order to expand the tubular blank 26 into a polygonal sidewall 12. The inside score lines 22 facilitate the necessary bends on corners in the sidewall 12. The lower end cap is then positioned the sidewall 12. This can be done either by inserting an end cap 14 into the upper end of the open sidewall 12 and pushing it through to the bottom; or by inserting the end cap into the open upper end of the sidewall and then opening the fixture 36 as indicated by arrows 48 and 50 so that the partially assembled container 10 can be removed from the fixture, inverted and reinserted - so as to receive the product 16 therein followed by the top end cap 14.

After the container 10 has been filled and closed, it is removed from the fixture 36 and directed through an automatic taper (not shown) which secures the end caps 14 to the sidewall 12 to seal the container for shipment.

From the foregoing, it will thus be apparent that the present invention comprises an improved composite container having numerous advantages over the prior art. One important advantage comprises the use of foam end caps which serve to close the ends of the straight polygonal sidewall, as well as to cushion the product therein. This avoids the use of folding end flaps and the waste associated therewith. The configuration of the container herein enables better shipping volume utilization. The sidewall can easily be cut to length as necessary, and the number of cross-sectional sizes of sidewalls can be reduced to a few standard sizes thereby simplifying inventory. The number of sizes of end caps can also be reduced, thus further simplifying inventory. Other advantages will be evident to those skilled in the art.

Although particular embodiments of the invention have been illustrated in the accompanying Drawings and described in the foregoing Detailed Description, it will be understood that the invention is not limited only to the embodiments enclosed, but is entended to embrace any alternatives, equivalents, modifications and/or rearrangements of elements following within the scope of the invention as defined by the following claims.

What is claimed is:

1. A composite shipping container, which comprises:

an upright, tubular sidewall of predetermined polygonal cross-section having opposite open ends;

said sidewall being formed from a rectangular blank of corrugated fiberboard having inside and outside surfaces, opposite edges, opposite ends, and means for securing the ends together in abutting relationship;

the inside surface of said blank being longitudinally scored at predetermined spaced apart locations and folded thereat to define corners between adjacent flat portions of said sidewall, with the corrugations thereof oriented generally circumferentially for improved rip resistance at the ends of said sidewall;

a pair of foam end caps of similar polygonal cross-section, one seated in each end of said sidewall, to close the container and cushion a product therein against shock;

each end cap including a flat outer end surface flush with the associated end of said sidewall, a recessed inner end surface and a surrounding raised inner end surface, a surrounding outside surface with alternating corners and flat portions joining the outer and raised inner end surfaces at a chamfered edge to facilitate receipt in an end of said sidewall, and a surrounding inside surface joining the recessed and raised inner end surfaces;

the inner surfaces of said end caps being adapted to receive and engage therebetween the product to be shipped; and means for securing each end cap to said sidewall.

2. The container of claim 1, wherein said means for securing said end caps to said sidewall comprises adhesive tape.

3. The container of claim 1, wherein said sidewall and said end caps are of octagonal cross-section.

4. The container of claim 1, wherein the fiberboard of said sidewall is of the 275 lb. type with a mullen burst strength of 200 and a B or C flute.

5. The container of claim 1, wherein said end caps are formed from solid expanded polystyrene foam having a density of at least 1.5 lb. per cubic foot.

* * * * *